United States Patent [19]

Pollack

[11] Patent Number: 4,903,962

[45] Date of Patent: Feb. 27, 1990

[54] ANGLED WEIGHTLIFTING BAR

[76] Inventor: Lance Pollack, 740 NE. 178th Ter., North Miami Beach, Fla. 33162

[21] Appl. No.: 299,133

[22] Filed: Jan. 23, 1989

[51] Int. Cl.[4] ..... A63B 13/00

[52] U.S. Cl. ..... 272/123

[58] Field of Search ..... 272/67, 68, 93, 117, 272/122, 123, 124, 128, 143

[56] References Cited

U.S. PATENT DOCUMENTS

| | | | |
|---|---|---|---|
| 460,270 | 9/1891 | Somerby | 272/128 X |
| 4,231,569 | 11/1980 | Rae | 272/122 |
| 4,252,316 | 2/1981 | Price | 272/143 X |
| 4,360,198 | 11/1982 | Waulters | 272/123 X |
| 4,605,222 | 8/1986 | Shannon | 272/123 X |
| 4,717,147 | 1/1988 | Rochelle | 272/117 |

FOREIGN PATENT DOCUMENTS

| | | | |
|---|---|---|---|
| 2191413 | 12/1987 | United Kingdom | 272/123 |

*Primary Examiner*—Richard J. Apley
*Assistant Examiner*—Robert W. Bahr

[57] ABSTRACT

A weightlifting bar, which is adapted for use as a barbell, comprises a straight center section having a longitudinal axis, a pair of connector sections extending radially outwardly from each end of the center section, and a weight-receiving side section extending sidewardly from the extended end of each connector section and radially inwardly at an acute angle toward the longitudinal axis. Each of the connector sections is freely rotatable about the center section, and each of the side sections is freely rotatable about its mounting in its connector section. The bar, with weight plates symmetrically loaded on the side sections, and supported by its center section, has a center of gravity that is substantially lower than the center section, and substantially constant with respect to the center section regardless of the rotational position of the center section about the longitudinal axis.

8 Claims, 2 Drawing Sheets

ANGLED WEIGHTLIFTING BAR

BACKGROUND OF THE INVENTION

1. Field of the Invention

This invention relates to a novel weightlifting bar that is adapted to receive weight plates thereon to form a barbell, and particularly to a novel barbell bar wherein the overall center of gravity of the bar, when symmetrically loaded with free weight, is always lower than the portion of the bar that is grasped and raised by the user.

2. Description of the Prior Art

Weightlifting bars are used by body builders and power lifters during exercises to increase their skeletal muscle mass and to increase their strength. The bars are used as handles to lift replacable disc-shaped weight plates that are attached at both ends of the bar. When the handle is short and the weighted bar can be manipulated with one hand, the weighted bar is called a dumbbell. When the handle is long and the weighted bar must be manipulated with two hands, this weighted bar is called a barbell. There are many different designs of these bars for use as barbells and dumbbells. Such bars are described in U.S. Pat. Nos. 1,013,782 to J. Koch; 2,508,567 to L. G. Dymeck; 2,722,419 to S. Tarapczynski; and 3,588,102 to L. F. Gifford.

Generally, weightlifting bars are formed from straight pieces of hollow tubes or solid rods and have straight end sections which are adapted to receive the weight plates. In order to adapt the bars for particular exercises, portions of the bars are bent so that the user's hands grasp the bar at particular angles with respect to the remainder of the bar, either to better exercise certain muscles or to avoid undesired stress on certain muscles or on the user's torso generally.

U.S. Pat. No. 4,605,222 to G. L. Shannon describes a weightlifting bar that may be considered a special purpose dumbbell designed for lifting relatively light loads with one or two hands. The bar described in the Shannon patent includes a straight short center section, a pair of short handles that extend radially at right angles from each end of the center section, and a pair of side sections extending at an acute angle with respect to the center section from the extended ends of each of the handles. The center of gravity of this weight-loaded bar is centered between the handles both laterally and longitudinally; that is, at about the middle of where the user ordinarily grasps the bar. Because of its configuration and the relative position of the center of gravity, this prior bar, when loaded with weights, can be used to perform a variety of exercises without undesirable torque loading on the user's wrists. If the center of gravity of the loaded bar is not centrally disposed between the handles at all times, greater or lesser torque would be experienced by the user as the movement of the user's wrists rotates the weight center outward and upward.

When using a barbell with very heavy weight loads, as in exercises known as a military press, a clean-and-jerk, and a snatch-and-jerk, better weight stability is desirable, especially when the user is at or near the limit of his lifting capability. An imbalance for any reason might cause the bar to tip and weight plates to shift off the one side and then off the other side of the bar, with the possibility of injury to the user and/or to a bystander.

In another set of exercises, the weight-loaded bar is used in conjunction with a weightbench. In these exercises, the bar is placed in a horizontal position on a holder comprising the bench. Weight plates are loaded symmetrically onto the bar. The user positions himself on the bench, raises the loaded bar off the holder, performs the desired exercise, and then returns the bar to the holder. The user is usually at or near the limit of his lifting ability and usually performs the exercises to the limit of his endurance. In both of these situations, upon reaching his limits, the user loses some measure of control over the loaded bar and the bar might tip, even when an assistant is present to help guide the bar. Usually, when using a bench, collars are not used to keep the weight plates from slipping off the side sections. So, especially in such situations, tipping this bar might result in weight plates slipping off the bar, with the possibility of injury to the user and/or the assistant.

When such heavy loads are being used, it is desirable for the weight-loaded bar to have a center of gravity that is substantially lower than the portion of the bar that is grasped by the user during the exercise. A lower center of gravity provides more stability, thereby helping to maintain the weight plates in position on the bar, and also gives the user more control over the weight-loaded bar. However, when raising the weight-loaded bar from an arms-down position to an arms-up position, the bar rotates. A low center of gravity in prior barbells produces increasing and undesirable torque and stress in the user's grasp as the weight center of the barbell is rotated outward and upward.

OBJECT OF THE INVENTION

An object of this invention is to provide a novel weightlifting bar that is adapted to be used in a barbell.

A further object is to provide a novel weightlifting bar having, when loaded with weight plates, a substantially constant center of gravity that is substantially below the grasped portion of the bar.

Another object is to provide a novel weightlifting bar on which loaded weight plates are more secure and more stable, even when the weight-loaded bar is tipped to one side.

Still another object is to provide a novel weightlifting bar adapted for use in a barbell and/or dumbbell and which allows the weighted sections of the bar to rotate freely with respect to the grasped section of the bar.

SUMMARY OF THE INVENTION

The novel weightlifting bar, which is adapted for use in a barell, comprises a straight center section having a longitudinal axis. A pair of connector sections extend radially outwardly from each end of the center section, and each connector section is freely rotatable with respect to the center section. A pair of straight weight-receiving side sections extend sidewardly from the extended ends of the connector sections in a common plane with the center section and radially inwardly at an acute angle toward said longitudinal axis. Each section is freely rotatable with respect to the connector section to which it is attached.

By displacing the weight-bearing side sections radially outwardly from the center section, a low center of gravity relative to the center section can be realized when the bar is weight-loaded. This permits each of the weight-bearing side sections to be angled radially inwardly. The low center of gravity and the angling of the side sections helps to stabilize weight plates that are attached to the side sections and gives the user better control of the weight-loaded bar. Also, there is a reduced chance of slippage of weight plates off of the side sections, should the weight-loaded bar tip to one side. The relative rotatability of the center section and the weight-bearing side sections maintain substantially constant the position of the center of gravity with respect to the center section regardless of the rotational postion of the center section around the longitudinal axis. This helps to maintain the weight plates in position on the side sections. It also avoids the imposition of any torque in the user's grasp regardless of the rotational position of the center section. Thereby, there is an overall increase in safety as well as increased convenience in the use of the novel weight-lifting bar.

In one form of novel bar, each connector section includes a center-section journal at each end portion of the center-section, a support bearing around each centersection journal, and a bearing housing supporting each of said support bearing, whereby the center section and housings are rotatable with respect to one another. In each said connector section, the rotatably-mounted housing extends radially outwardly from the center section, and includes an axle fixedly mounted to an extended portion of the housing. Each axle extends sidewardly and radially inwardly towards the longitudinal axis of the center section. Each side section includes a pair of spaced journals on each axle, a side-section bearing on each spaced journal and a tubular weight-receiving sleeve around and extending between each side-section bearing on each axle, whereby each sleeve is rotatable around one of said axles.

DETAILED DESCRIPTION OF THE INVENTION INCLUDING THE PREFERRED EMBODIMENTS

Figure 1:
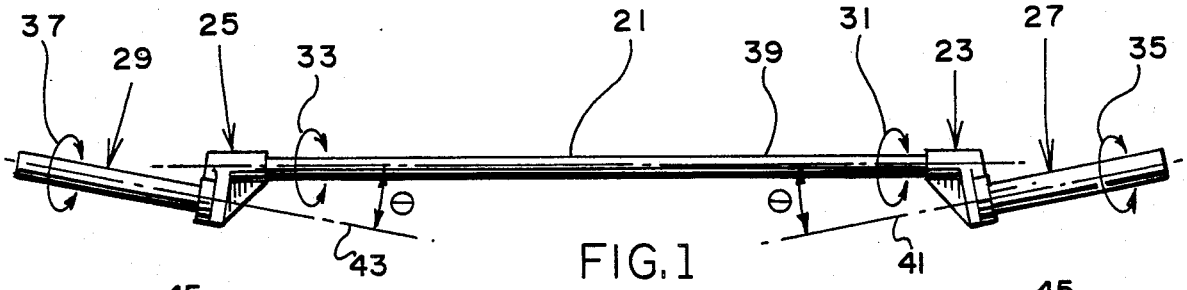
FIG. 1 is an elevational view of a preferred embodiment of the novel weightlifting bar.

The following description of some of the preferred embodiments of the concepts of this invention is made in reference to the accompanying figures. Where an individual structural element is depicted in more than one figure, it is assigned a common reference numeral for simplification of identification and understanding.

As shown in FIG. 1, the novel weightlifting bar comprises a center section 21, a right connector section 23 extending radially outwardly from the right end of the center section 21, a left connector section 25 extending radially outwardly from the left end of the center section 21, a right cylindrical weight-receiving side section 27 extending sidewardly and at an angle theta inwardly from the extended portion of the right connector section 23, and a left cylindrical weight-receiving side section 29 extending sidewardly and at an angle theta inwardly from the extended portion of the left connector section 25. The center section 21 and the right connector section 23 are rotatable with respect to one another, as shown by the first arrow 31. The center section 21 and the left connector section 25 are rotatable with respect to one another, as shown by the second arrow 33. The right connector section 23 and the right side section 27 are rotatable with respect to one another as shown by the third arrow 35. The left connector section 25 and the left side section 29 are rotatable with respect to one another as shown by the fourth arrow 37.

The center section 21 is a solid, cylindrical steel bar having a longitudinal axis 39. Instead of a solid bar, the center section 21 may be a hollow tube or pipe and may be constituted of any mechanically strong material. The connector sections 23 and 25 extend radially outwardly from the center-section longitudinal axis 39. The right side section 27 has a right longitudinal axis 41 at an angle theta with respect to and intersecting the center-section longitudinal axis 39, in such manner that the right side section 27 extends longitudinally outwardly and radially inwardly towards the center-section longitudinal axis 39. The left side section 29 has a left longitudinal axis 43 at an angle theta with respect to and intersecting the center-section longitudinal axis 39, in such manner that the left side section 29 extends longitudinally outwardly and radially inwardly towards the center-section longitudinal axis 39. The center, right and left axes 39, 41 and 43 are all in substantially the same plane.

Figure 2:
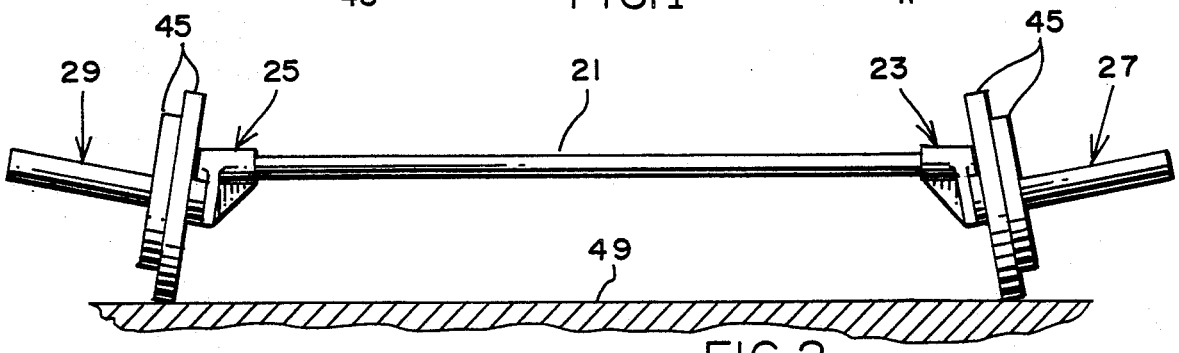
FIG. 2 is an elevational view of the novel bar shown in FIG. 1 loaded with weight plates and resting on a level floor.
Figure 3:
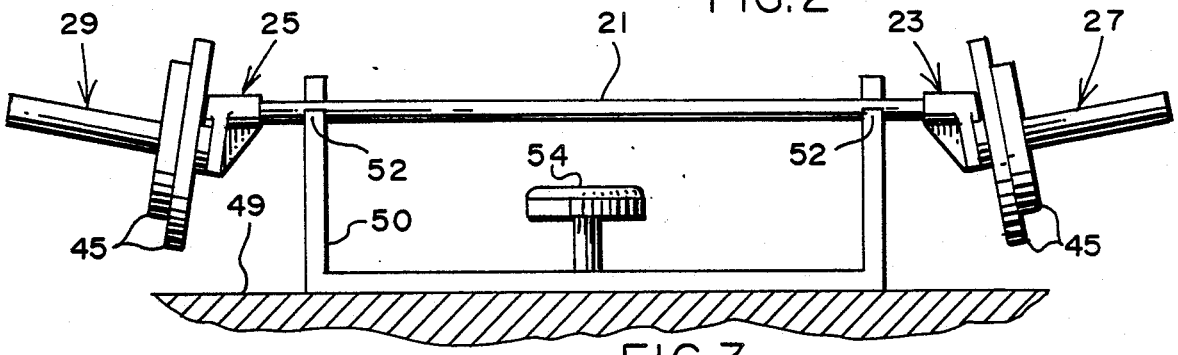
FIG. 3 is an elevational view of the novel bar shown in FIG. 1 loaded with weight plates and resting on a weightbench.

FIG. 2 shows the right and left side sections 27 and 29 each loaded with equal amounts of weight in the form of two disc-shaped weight plates 45. This assembly rests on a substantially level floor 49, alternatively, the assembly may rest on a weightbench 50 as shown in FIG. 3. The weightbench 50 includes holders 52 for the center section 21 of a bar and a seat 54 for the user.

The connector sections 23 and 25 offset the weight-receiving side sections 27 and 29, so that the overall center-of-gravity of the novel bar when properly loaded with weight plates; for example, as shown in FIGS. 2 or 3, is substantially lower than for an ordinary straight bar or its functional equivalent.

The lower center-of-gravity permits the weigh-treceiving side sections 27 and 29 to be slightly angled radially inwardly from its attached proximal end to its extended distal end. The relative rotatability of the sections, as shown by the arrows 31, 33, 35 and 37, keeps the side sections 27 and 29 angled upwardly regardless of the position of the bar during its use. This upward angle is shown by the symbol theta and can be set during manufacturing to accomodate individual training needs. In the embodiment shown, the angle theta is about 10 degrees, but may be as large as 30 degrees.

The low overall center-of-gravity of the weight-loaded bar and the angling up of the weight-receiving side sections 27 and 29 helps to make the free weight that is loaded on the side sections 27 and 29 more stable on the bar, and gives the user added control over the bar during use. The relative rotatability of the sections keeps the overall center-of-gravity as low as possible and reduces torque to the user's wrists, forearms, etc. to a minimum, which adds to the safety of using the novel bar. It is noteworthy that the novel bar has a self-securing system to reduce slippage of the weight plates 45, even when the weight-loaded bar is supported unevenly.

Figure 4:
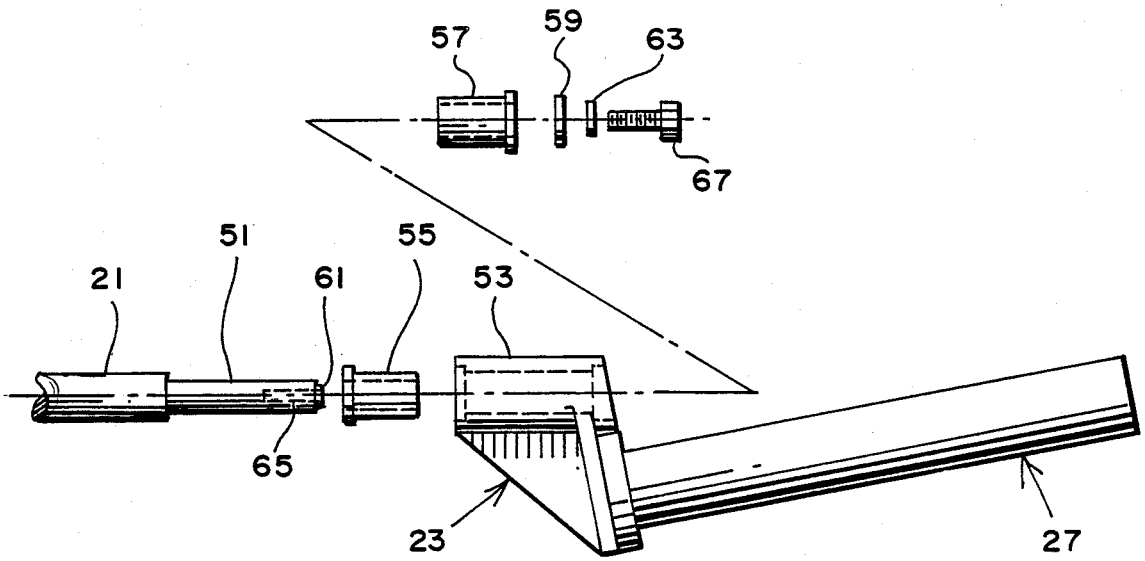
FIG. 4 is an exploded view of the parts providing rotatability between the center section and the right connector section of the preferred embodiment shown in FIG. 1.
Figure 6:
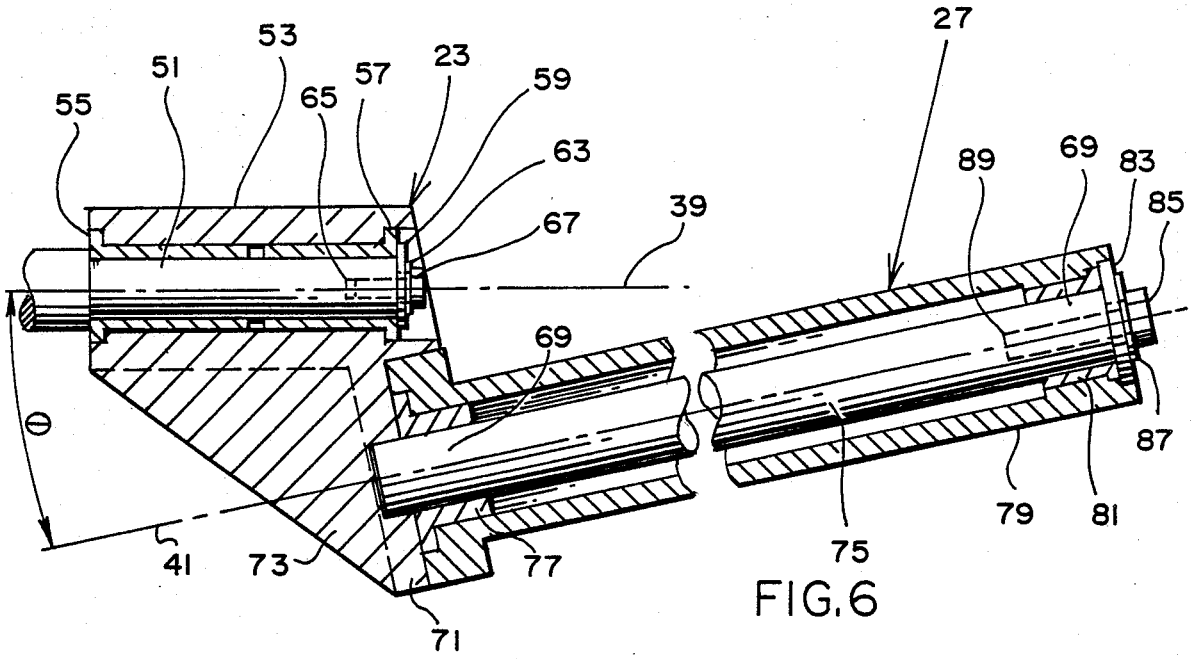
FIG. 6 is a sectional elevational view of the right connector section and the right side section of the preferred embodiment shown in FIG. 1, with all the parts shown in FIG. 4 and 5 properly assembled.
Figure 5:
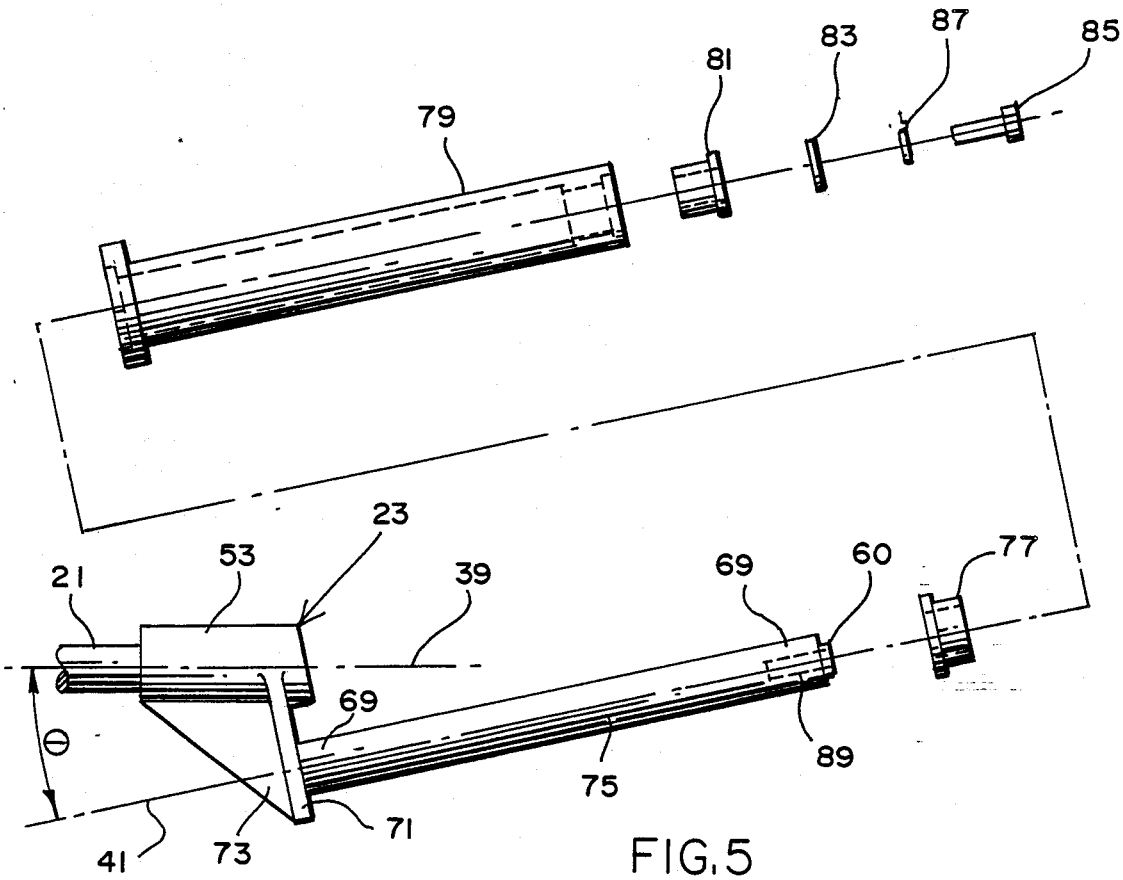
FIG. 5 is an exploded view of the parts providing rotatability between the right connector section and the weight-receiving portion of the right side section of the preferred embodiment shown in FIG. 1.

FIGS. 4, 5 and 6 show preferred means for providing rotatability among the sections 21, 23 and 27 on the right side of the bar. A similar mirror image structure is provided on the left side of the bar. Also, other structural means can be used to provide the desired rotatability.

As shown in FIGS. 4 and 6, the right end portion of the center section 21 includes a cylindrical center journal 51, and the right connector section 23 includes a bearing housing 53. A cylindrical inner weight-support bearing 55 is slid into one side of the bearing housing 53 and a cylindrical outer weight-support bearing 57 is slid into the other side of the bearing housing 53. Then, the inner and outer bearings 55 and 57 (which are seated in the housing 53) are slid into place around the center journal 51. A weight-support retaining washer 59 is placed around a boss 61 at the end of the center journal 51. Then, a weight-support bolt 67 with a lock washer 63 around it is screwed into a threaded aperture 65 at the end of the journal 51. The journal 51, and therefore the center section 21, is free to rotate in the bearings 55 and 57, and conversely the housing and its attachments are free to to rotate around the journal 51.

As shown in FIGS. 5 and 6, the right connector section 23 includes a right extension 71 and stiffening web 73 attached to the bearing housing 53. An axle 75 having said right longitudinal axis 41 is fixedly mounted at one end thereof in the right extension 71 in cantilever fashion. A cylindrical inner sleeve bearing 77 is slid into one end of a tubular weight-receiving sleeve 79, and a cylindrical outer sleeve bearing 81 is slid into the other end of the weight-receiving sleeve 79. Then, the inner and outer sleeve bearings 77 and 81 (which are seated in the sleeve 79) are slid into place around the axle 75 on a pair of side-section journals 69 located at the end portions of each axle. A sleeve retaining washer 83 is positioned over boss 60 and the end of the sleeve and a sleeve bolt 85 having a sleeve lock washer 87 around it is screwed into a threaded aperture 89 at the end of the axle 75. The sleeve 79 and sleeve bearings 77 and 81 are free to rotate around the axle 75.

The foregoing figures and description thereof are provided as illustrative of some of the preferred embodiments of the concepts of this invention. While these embodiments represent what is regarded as the best modes for practicing this invention, they are not intended as delineating the scope of the invention, which is set forth in the following claims.

What is claimed is:

1. A weightlifting bar adapted to receive weight plates thereon to form a barbell comprising:

a straight center section having a longitudinal axis, a pair of connector sections extending radially from each end of said center section, said connector sections being freely rotatable with respect to said center section, and a pair of straight weight-receiving side sections extending sidewardly from said connector sections in a common plane, each side section being freely rotatable with respect to the connector section to which it is attached, whereby said weightlifting bar, when symmetrically loaded with weight plates on said side sections and supported by said center section, has a center of gravity that is substantially lower than said center section, and the position of said center of gravity relative to said center section remains substantially constant regardless of the rotational position of said center section around said longitudinal axis, wherein each of said side sections extends sidewardly at an acute angle with respect to said center-section longitudinal axis and radially inwardly towards said longitudinal axis.

2. The bar defined in claim 1 wherein each connector section includes a center-section journal at each end portion of said center section, a support bearing around each journal and a housing supporting each of said support bearings.

3. The bar defined in claim 1 wherein each connector section includes a housing rotatably mounted at each end of said center section, said housing extending radially from each end of said center section, and an axle fixedly mounted at one proximal end thereof to an extended portion of said housing, each axle extending sidewardly from said housing at an acute angle with respect to said longitudinal axis and in a common plane with said center section.

4. The bar defined in claim 3 wherein each side section includes a side-section journal at each end portion of each axle, a side-section bearing around each side-section journal, and a tubular weight-receiving sleeve supported around and extending between each of said side-section bearings on said journals of each axle, whereby each tubular sleeve is rotatable around one of said axles and whereby weight plates symmetrically loaded on said sleeves are stably positioned thereon.

5. The bar defined in claim 3 wherein each axle has a side-section longitudinal axis which intersects at an acute angle with said center-section longitudinal axis.

6. A weightlifting bar adapted to receive weight plates thereon to form a barbell comprising:

a straight center section having a longitudinal axis, a pair of connector sections rotatably mounted at each end of and extending radially from said center section in substantially the same plane, and a pair of straight weight-receiving side sections, each side section extending longitudinally outwardly in said plane from the extended end of one of said connector sections, and radially inwardly forming an acute angle of 30 degrees or less with said center section, each connector section comprising an axle fixedly mounted in said connector section at said acute angle, and each side section including a tubular weight-receiving sleeve rotatably mounted on one of said axles, whereby said weightlifting bar, when symmetrically loaded with weight plates on said side sections and supported by said center section, has a center of gravity that is substantially lower than said center section, and whereby said center of gravity relative to said center section remains substantially constant regardless of the rotational position of said center section around said longitudinal axis.

7. The bar defined in claim 6 wherein said connector section includes a center-section journal at each end portion of said center-section, a support bearing around each center-section journal, and a housing supporting each side support bearing, whereby said center section and said housing are rotatable with respect to one another.

8. The bar defined in claim 6 wherein each said side-section includes a side-section journal at each end portion of each of said axles, a side-section bearing around each side section journal, and a tubular weightreceiving sleeve supported around and extending between each of said side-section bearing on the side-section journals of each axle, whereby each said tubular sleeve, is rotatable around one of said axles.

* * * * *